US007295676B2

(12) United States Patent
Chalupper

(10) Patent No.: US 7,295,676 B2
(45) Date of Patent: Nov. 13, 2007

(54) HEARING AID AND METHOD OF ADAPTING A HEARING AID

(75) Inventor: Josef Chalupper, Paunzhausen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 336 days.

(21) Appl. No.: 10/981,262

(22) Filed: Nov. 4, 2004

(65) Prior Publication Data

US 2005/0094834 A1 May 5, 2005

(30) Foreign Application Priority Data

Nov. 5, 2003 (DE) ..... 103 51 509

(51) Int. Cl.
*H04R 25/00* (2006.01)

(52) U.S. Cl. ..... 381/313; 381/92

(58) Field of Classification Search ..... 381/23.1, 381/92, 313, 310, 1, 109, 91, 122; 700/94; 367/124, 129
See application file for complete search history.

(56) References Cited

U.S. PATENT DOCUMENTS

| | | | | |
|---|---|---|---|---|
| 4,354,059 | A * | 10/1982 | Ishigaki et al. | 381/92 |
| 2003/0231773 | A1* | 12/2003 | Drtina | 381/17 |
| 2004/0208332 | A1* | 10/2004 | Baechler | 381/315 |
| 2005/0286728 | A1* | 12/2005 | Grosvenor et al. | 381/91 |
| 2006/0233406 | A1* | 10/2006 | Fischer | 381/313 |

FOREIGN PATENT DOCUMENTS

| | | |
|---|---|---|
| DE | 101 48 006 A1 | 6/2003 |
| EP | 1 017 253 A2 | 7/2000 |

* cited by examiner

*Primary Examiner*—Sinh Tran
*Assistant Examiner*—Joseph Saunders, Jr.

(57) ABSTRACT

With the adaptation of a hearing aid to a multitude of acoustic sources, head movements can be taken into consideration more rapidly. To this end, a position determining device (PB) for determining the current position of the head of the hearing aid wearer is provided, so that with the aid of the position of the head in a processing and separation unit (VE), the relative change in the acoustic source positions can be rapidly taken into consideration. Thus after each head movement, a renewed time-intensive adaptation is not required.

26 Claims, 1 Drawing Sheet

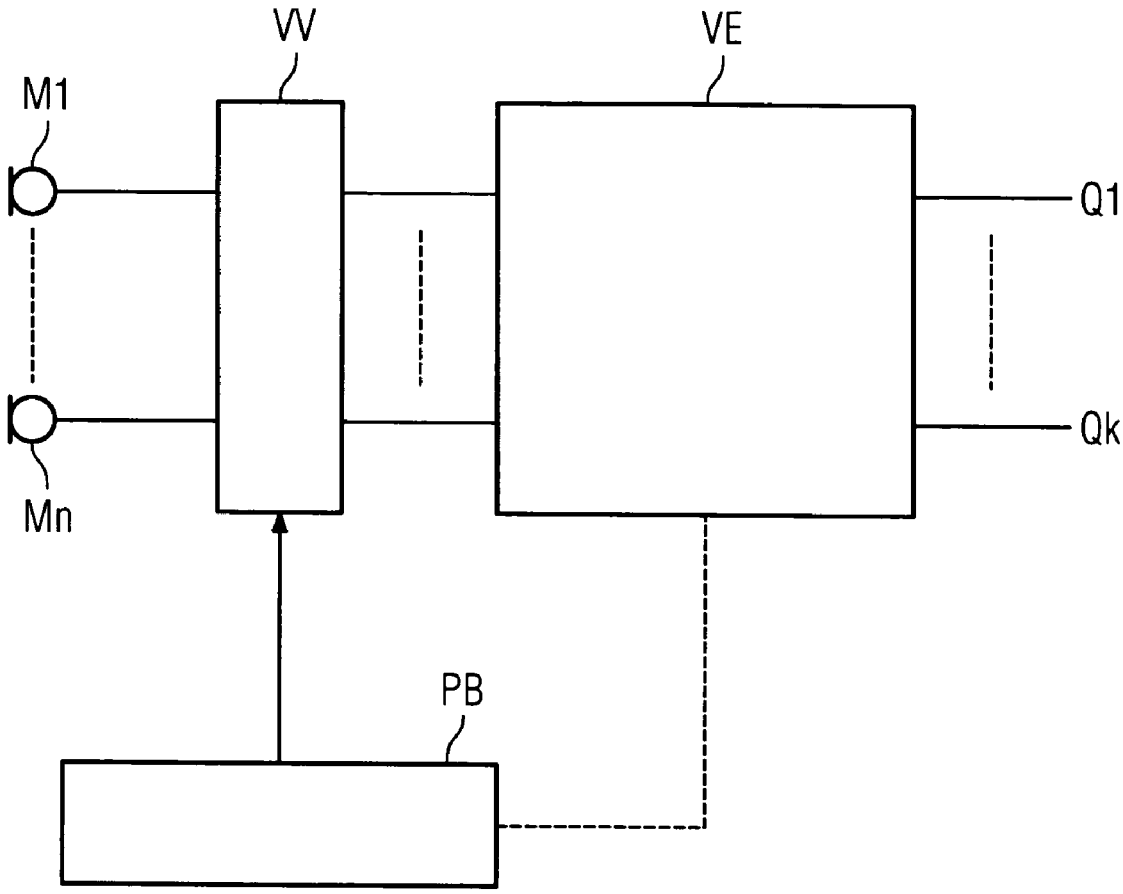
VV
VE
M1
Q1
Qk
Mn
PB

HEARING AID AND METHOD OF ADAPTING A HEARING AID

CROSS REFERENCE TO RELATED APPLICATIONS

This application claims priority to the German application No. 10351509.7, filed Nov. 5, 2003 and which is incorporated by reference herein in its entirety.

FIELD OF INVENTION

The present invention relates to a hearing aid which can be adapted to the spatial direction of an incoming acoustic signal, having a plurality of microphones for recording input signals and a computing device for calculating at least one direction from which a predefined acoustic signal comes in. Furthermore, the present invention relates to a corresponding method for adapting a hearing aid to at least one spatial direction of the acoustic incidence.

BACKGROUND OF INVENTION

Using the known method of blind source separation BSS, a plurality of spatially distributed speakers who are talking simultaneously can be separated and emphasis can be placed on one of them in order to improve his/her audibility. BSS is disclosed in more detail in the publication EP 1 017 253 A2, whereby the useful acoustic source wanted by the hearing aid wearer is highlighted from a signal mixture. This or similar methods nevertheless require an adaptation time of several seconds, until the directions of the speakers can be reliably estimated. Because of unavoidable head movements which each time necessitate a renewed adaptation, these algorithms are thus currently only suitable for hearing aids to a limited extent.

SUMMARY OF INVENTION

An object of the present invention is thus to be able to implement a source separation in hearing aids, in a reasonable time frame despite head movements.

In accordance with the invention, this object is achieved by the claims. A hearing aid is adapted to the spatial direction of an incoming acoustic signal, having a plurality of microphones for recording input signals and a computing device for calculating at least one direction from which a predefined acoustic signal comes in, on the basis of the input signals and a position determining device for determining the current position of the head of the hearing aid wearer, so that with the aid of the position of the head the direction, of which there is at least one, to be calculated in the calculating unit can be influenced.

Furthermore, in accordance with the invention a method is provided for adapting a hearing aid to at least one spatial direction of an acoustic signal arriving at the hearing aid, by way of recording a plurality of microphone input signals, calculating the at least one direction from which a predefined acoustic signal comes in based on the microphone input signals, changing the position of the head of the hearing aid wearer as well as determining the current position of the head of the hearing aid wearer and influencing the direction calculated or to be calculated, of which there is at least one, from which the acoustic signal comes in, based on the current position of the head.

By avoiding a renewed adaptation process after a head movement, the blind source separation can also be deployed in hearing aids, whereby the speech audibility can be drastically increased in certain situations.

In the case of a binaural supply, the hearing aid preferably comprises a transmission device for the wireless transmission of the head position to the second hearing aid. Thus it is sufficient that the hearing aid is designed with a position determining device for determining the head position. In many cases of binaural supply, the transmission device is in any case provided in the hearing aid.

The position determining device can be configured such that the position of the head is determined based on the earth's magnetic field. This is advantageous in that not only a relative, but also an absolute position of the head can be determined.

Alternatively, the position determining device can be configured such that the head position is determined with the aid of an acceleration sensor. This is advantageous in that current technology using robust components can be deployed.

With a simple embodiment of the invention, a head movement in the adapted state of the hearing aid is taken into account. With a further development, the current head position is also taken into account during the adaptation process in the hearing aid. Thus the time taken for adjusting the hearing aid is further reduced.

BRIEF DESCRIPTION OF THE DRAWING

The present invention is now illustrated in further detail with reference to the attached drawing, which shows a block diagram of an inventive hearing aid.

The subsequent exemplary embodiment described in further detail illustrates a preferred embodiment of the present invention.

DETAILED DESCRIPTION OF INVENTION

A hearing aid according to the presentation in the drawing comprises several microphones M1, Mn. The signals of the microphones are recorded by a preprocessing unit VV. A position determining unit PB, such as a magnetic flux gate or an accelerometer, similarly sends the current head position to the preprocessing unit VV. The preprocessed signals of the preprocessing unit BB are forwarded in parallel to an adaptive processing and separation unit VE. As a result, the unit VE provides the signals of the different sources Q1, Qk. Alternatively or in addition, the head position can also be routed to the processing and separation unit by means of the position determining unit PB.

A commercially available so-called Head Tracker is used as a position determining device PB, which uses the earth's magnetic field for example to determine the position. In operation, the Head Tracker continuously routes the current head position to the preprocessing unit VV. With binaural supply, this information is also preferably transmitted wirelessly to the hearing aid on the other side of the head.

In the preprocessing unit VV, the current position is calculated using the microphone signals such that in the case of a head movement, the change in direction of the microphones is taken into consideration such that, on the basis of the head movement, no new adaptation must be carried out, as long as the external speakers and/or acoustic sources do not change their positions. If the head movement already takes place during the adaptation, the head movement must be correspondingly temporally registered. In this case, the time dependency of the signals must be taken into consideration during the adaptation process. In one example embodiment, the adaptation process may include adjusting an acoustic parameter of the hearing aid. The acoustic parameter may be used for weighting the microphone input sianals. In another example embodiment, the adaptation process may include mixing at least two of the microphone input signals using a phase shift of one of the input signals.

The invention claimed is:

1. A hearing aid, comprising:

a plurality of microphones for acquiring a plurality of input signals;

a position determining device for detecting a position of the head of a user of the hearing aid; and a computing device for identifying an incoming direction of an acoustic signal based upon the input signals and the head position, wherein the position determining device includes a flux gate for detecting the earth's magnetic field.

2. The hearing aid according to claim 1, wherein the hearing aid adapts itself based upon the incoming direction.

3. The hearing aid according to claim 2, wherein adapting by the hearing aid includes adjusting an acoustic parameter of the hearing aid.

4. The hearing aid according to claim 3, wherein the acoustic parameter is used for weighting the microphone input signals.

5. The hearing aid according to claim 2, wherein adapting by the hearing aid includes mixing at least two of the microphone input signals using a phase shift of one of the input signals.

6. A hearing aid system, comprising:

a first and a second hearing aid for binaural support of a user of the hearing aid system;

a position determining device for detecting a position of the head of the user;

a computing device for identifying an incoming direction of an acoustic signal based upon the input signals and the head position; and a transmission device for wirelessly transmitting the position of the head from the first to the second hearing aid, wherein the position determining device includes a flux gate for detecting the earth's magnetic field.

7. The hearing aid system according to claim 6, wherein the hearing aid system adapts itself based upon the incoming direction by adjusting an acoustic parameter of the hearing aid.

8. The hearing aid system according to claim 7, wherein the acoustic parameter is used for weighting the microphone input signals.

9. The hearing aid system according to claim 7, wherein adapting by the hearing aid system includes mixing at least two of the microphone input signals using a phase shift of one of the input signals.

10. A hearing aid, comprising:

a plurality of microphones for acquiring a plurality of input signals;

a position determining device for detecting a position of the head of a user of the hearing aid; and a computing device for identifying an incomina direction of an acoustic signal based upon the input signals and the head position, wherein the position determining device includes an accelerometer for determining the position of the head.

11. The hearing aid according to claim 10, wherein the hearing aid adapts itself based upon the incoming direction.

12. The hearing aid according to claim 11, wherein adapting by the hearing aid includes adjusting an acoustic parameter of the hearing aid.

13. The hearing aid according to claim 12, wherein the acoustic parameter is used for weighting the microphone input signals.

14. The hearing aid according to claim 11, wherein adapting by the hearing aid includes mixing at least two of the microphone input signals using a phase shill of one of the input signals.

15. A hearing aid system, comprising:

a firat and a second hearing aid for binaural supnort of a user of the hearing aid system;

a position determining device for detecting a position of the head of the user;

a computing device for identifying an incoming direction of an acoustic signal based upon the input signals and the head position; and a transmission device for wirelessly transmitting the position of the head from the first to the second hearing aid, wherein the position detemuning device includes an accelerometer for determining the position of the head.

16. A method of adapting a hearing aid, comprising:

acquirinsg a plurality of micronhone input signals;

determining a position of the head of a heating aid user;

identifying an incoming direction of an acoustic signal using the microphone input signals and the position of the head, wherein the position of the head is determined using the earth's magnetic field.

17. The method according to claim 16, wherein the head position is transmitted wirelessly to a further hearing aid, the hearing aid and the further hearing aid forming a hearing aid system for binaurally supplying the hearing aid user.

18. The method according to claim 16, further comprising adapting the hearing aid using the incoming direction.

19. The method according to claim 18, wherein adapting the hearing aid includes adjusting an acoustic parameter of the hearing aid.

20. The method according to claim 19, wherein the acoustic parameter is used for weighting the microphone input signals.

21. The method according to claim 16, wherein at least two of the microphone input signals are mixed including a phase shift of one of the input signals.

22. A method of adapting a hearing aid, comprising:

acquiring a plurality of microphone input signals;

determining a position of the head of a hearing aid user;

identifying an incoming direction of an acoustic signal using the microphone input signals and the position of the head, wherein the position of the head is determined using an accelerometer for determining an acceleration vector of the head.

23. The method according to claim 22, further comprising adapting the hearing aid using the incoming direction.

24. The method according to claim 23, wherein adapting the hearing aid includes adjusting an acoustic parameter of the hearing aid.

25. The method according to claim 24, wherein the acoustic parameter is used for weighting the microphone input signals.

26. The method according to claim 23, wherein adapting by the hearing aid includes mixing at least two of the microphone input signals using a phase shift of one of the input signals.

* * * * *